US008348279B2

(12) United States Patent
Burton

(10) Patent No.: US 8,348,279 B2
(45) Date of Patent: Jan. 8, 2013

(54) MAGNETIC HOUSE PUZZLE

(76) Inventor: Peter Burton, Worcestershire (GB)

( * ) Notice: Subject to any disclaimer, the term of this patent is extended or adjusted under 35 U.S.C. 154(b) by 182 days.

(21) Appl. No.: 12/806,442

(22) Filed: Aug. 11, 2010

(65) Prior Publication Data

US 2011/0037223 A1 Feb. 17, 2011

(51) Int. Cl.
*A63F 9/34* (2006.01)

(52) U.S. Cl. ..... 273/157 R; 273/153 R; 273/156

(58) Field of Classification Search ..... 273/153 R, 273/156, 157 R
See application file for complete search history.

(56) References Cited

U.S. PATENT DOCUMENTS 2,570,625 A * 10/1951 Zimmerman et al. ..... 446/92
2,939,243 A * 6/1960 Duggar ..... 446/92
3,608,906 A * 9/1971 Odier ..... 273/157 R
3,659,360 A * 5/1972 Zeischegg ..... 434/403
3,993,313 A * 11/1976 Tillotson ..... 273/282.1
4,021,939 A * 5/1977 May ..... 434/403
4,741,534 A * 5/1988 Rogahn ..... 273/157 R
6,241,249 B1 * 6/2001 Wang ..... 273/156
7,389,908 B2 * 6/2008 Cohen ..... 229/116
7,413,493 B2 * 8/2008 Toht et al. ..... 446/92
7,887,056 B2 * 2/2011 Tenorio ..... 273/156
2005/0067780 A1 * 3/2005 Sanyal et al. ..... 273/156
2011/0037223 A1 * 2/2011 Burton ..... 273/157 R
2012/0032393 A1 * 2/2012 Leicht ..... 273/156
2012/0056376 A1 * 3/2012 Morrison ..... 273/157 R

* cited by examiner

*Primary Examiner* — Raleigh W. Chiu
(74) *Attorney, Agent, or Firm* — Thomas I. Rozsa

(57) ABSTRACT

A take-apart puzzle consisting of a small number of identical looking bricks which are held together by the mutual magnetic attraction of their internally hidden magnets. The puzzle is disassembled by separating the bricks from one another. Upon separation it will be found that one or more of the magnets within the bricks have moved and/or rotated thereby causing one or more of the bricks to now mutually repel one another. The bricks will not be attracted to each other, thus forcing the so-moved magnets back into their original positions. The puzzle is made all the more tantalizing to solve by the fact that magnetic fields cannot be readily seen and the puzzle only consists of a small number of separate pieces.

12 Claims, 13 Drawing Sheets

Brick No. 20

Brick No. 30

Brick No. 40

Brick No. 50

Brick No. 60

MAGNETIC HOUSE PUZZLE

BACKGROUND OF THE INVENTION

1. Field of the Invention

The present invention relates to the field of take apart puzzle which are puzzled formed into given shape and which is assembled by combining several separate components of the puzzle. When the component are separated from each other so that the puzzle is disassembled, the problem to be solved is to reassemble the puzzle into the original shape.

2. Description of the Prior Art

In general, take apart puzzles are known in the prior art. However, the present inventor is unaware of any puzzle where at least two of the components are attracted to each other by hidden magnets and the orientation of a set of magnets in at least one component can be scrambled to enhance the difficulty of reassembling the puzzle.

SUMMARY OF THE INVENTION

The present invention relates to a puzzle in the shape of a house. One class of puzzles is known by the name take-apart puzzles and the present invention is in this class, but with a difference.

The present invention comprises a small number of bricks which when brought into close proximity with each other, make up the basic shape of a house. Once the bricks of the present invention are taken apart from each other, the puzzle solver will have the greatest of difficulty in returning the bricks back to their original configuration, even if the puzzle solver carefully replaces the bricks in the reverse order from which they are taken apart. This heightened level of difficulty is what makes the present invention very hard to solve even through the number of separate bricks making up the complete puzzle is quite small.

To facilitate this, the present invention proposes that sonic or all of the bricks comprising the puzzle have magnets within the body of these bricks. These magnets are hidden from the view of the puzzle-solver.

The aforesaid magnets are arranged in such a way as to hold all the bricks of the puzzle firmly together by their mutual magnetic attraction, thus making up the shape of a house when all the puzzle's bricks are brought together in the correct way.

Furthermore, one or more of the aforesaid magnets are allowed to move within the bricks in which they are housed. The movement of these magnets is brought about during or after the puzzle's bricks are completely removed from the magnetic influence of their adjacent bricks.

The movement of the aforesaid magnets results in these particular magnets taking up a different position within the bricks in which they are housed from that position in which they are in when the bricks are correctly assembled into the house shape. The different position to which these moving magnets finally come to rest within their respective bricks results in a mutual repulsion of the puzzle's adjacent bricks when those are brought into close proximity.

The aforesaid moving magnets are not allowed to return to their original positions within their respective bricks unless the puzzle-solver moves some or all in a very particular and precise way relative to the other bricks of the puzzle. Once the bricks have been moved with respect to each other in the particular way, the puzzle-solver can then proceed with the rest of the puzzle's assembly, thus returning the puzzle to its former starting position.

The present invention is a take-apart puzzle consisting of a small number of identical looking bricks which are held together by the mutual magnetic attraction of their internally hidden magnets. The puzzle is disassembled by separating the bricks from one another. Upon separation it will be found that one or more of the magnets within the bricks have moved and/or rotated thereby causing one or more of the bricks to now mutually repel one another. The bricks will not be attracted to each other, thus forcing the so-moved magnets back into their original positions. The puzzle is made all the more tantalizing to solve by the fact that magnetic fields cannot be readily seen and the puzzle only consists of a small number of separate pieces.

As the puzzle solver cannot see the magnetic fields, it will not be immediately obvious as to how the small number of bricks should be moved or placed relative to one another in order to complete the final solution to this puzzle. This fact makes the present invention's solution non-trivial, thus keeping the puzzle-solver occupied for a very long time in order to find the correct solution to this seemingly simple but very hard to solve puzzle.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
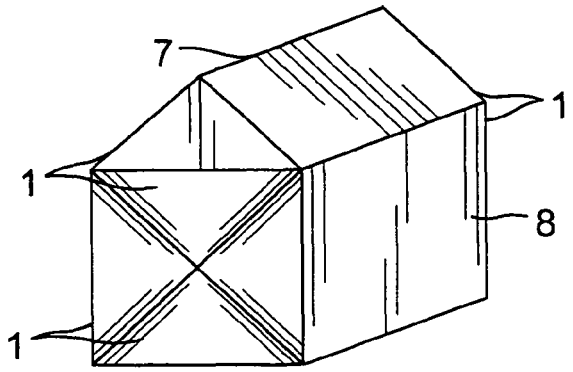
FIG. 1 shows an assemblage of five similarly shaped magnetic bricks which together make up the simple shape of a house.

When the puzzle is correctly assembled as shown in FIG. 1, all the similarly-shaped bricks 1 are magnetically attracted to each other in such a way that there is only one possible combination of positions that the bricks may take up to complete the puzzle's assembly.

Figure 2:
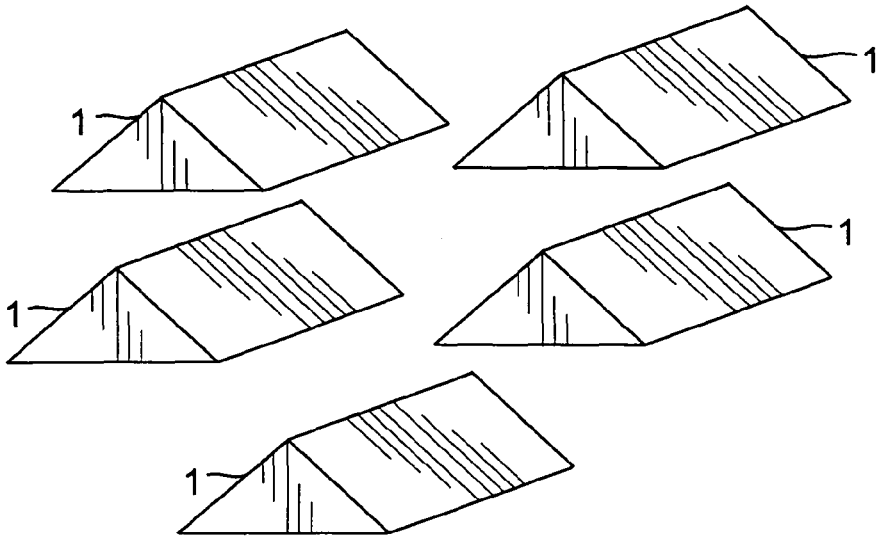
FIG. 2 shows the same bricks as in FIG. 1 but moved apart from one another.
Figure 3:
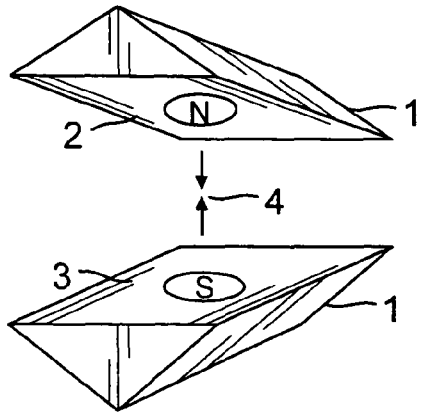
FIG. 3 shows just two of the puzzle's bricks with the positions of the magnets' poles depicted and indicating the attractive force between tern.

To solve the puzzle, the puzzle-solver first moves all the bricks away from one another as shown in FIG. 2. During this process of disassembly, as depicted in FIG. 3 with only two of the five bricks shown for clarity, the magnets 2 and 3, contained out of sight within the bricks, normally have their unlike poles coincident across adjacent bricks thus resulting in an attractive magnetic force 4 between the magnets of adjacent bricks thus resulting in an attractive magnetic force 4 between magnets of adjacent bricks thereby keeping the bricks together. All the magnets in all the bricks of the puzzle behave in this like manner.

The strength of the magnetic force 4 between all of the bricks making up the puzzle is so arranged as to keep all the bricks tightly held together in their solved positions, but not so strong as to prevent the easy removal of the bricks from one another by hand.

Figure 4:
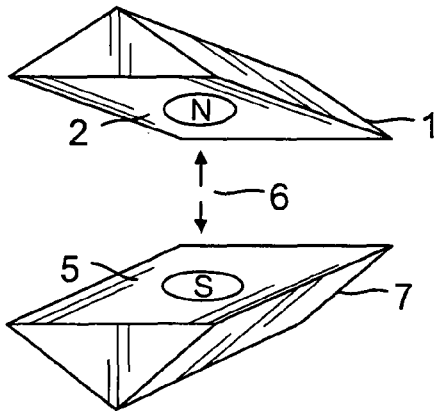
FIG. 4 shows just two of the puzzle's bricks with the positions of the magnets' poles depicted and indicating the repulsive force between them.
Figure 5:
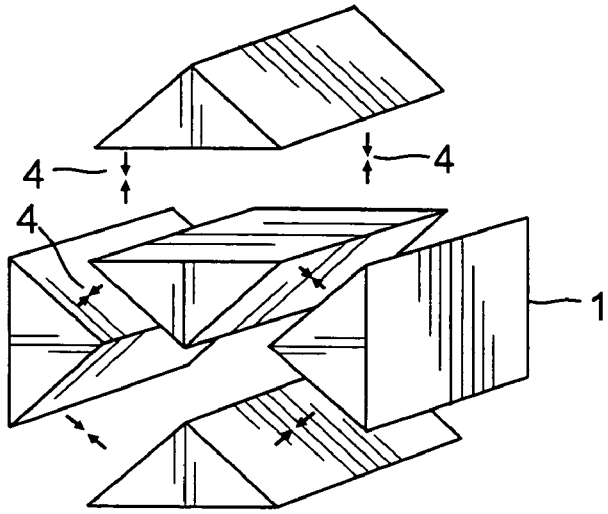
FIG. 5 shows the possible forces of magnetic attraction between all of the bricks of the present embodiment of the puzzle when correctly assembled.
Figure 6:
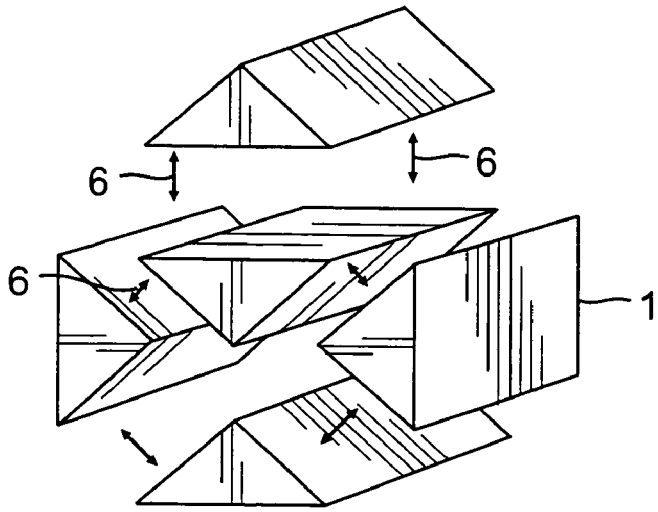
FIG. 6 shows the possible forces of magnetic repulsion between all of the bricks of the present embodiment of the puzzle after they have been moved apart from one another.

Upon removing all the bricks of the puzzle from one another, such that the attractive magnetic forces 4 between the bricks are diminished, one or more of the magnets 5 is caused to rotate within one or more of the bricks 7 in such a way that the magnetic fields emanating from their poles are now causing a repulsive force 6 between adjacent bricks as shown in FIGS. 4 and 6. This repulsive force so prevents those bricks containing the previously rotated magnets from being attracted to each other if the said bricks were to be immediately brought into close proximity again.

Thus, after the complete removal of all the bricks from one another, and with one or more of the bricks now containing rotated magnets, the bricks are found to be mutually repulsed from each other and will not be able to be formed into the previously completed puzzle.

The puzzle-solver must now put the bricks through a complicated series of motions, moving the bricks relative to one another in order to return the displaced magnets back to their original locations in their respective bricks. This will thus facilitate the complete assembly of the puzzle back to its original shape as depicted in FIG. 1.

The present embodiment of the invention may be enhanced by coloring the bricks in such a way as to depict a roof on the apex 7 and windows on the face 8 of each brick, thereby making the puzzle more closely and appealingly look like the outside of a stylized house. The coloring of each brick should be identical in every way to all of its partners so as not to give away any clues as to the final solution of the puzzle.

Figure 7:
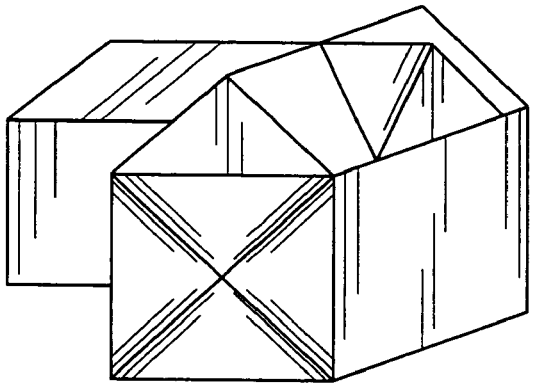
FIG. 7 shows a further embodiment of the present invention using a larger number of similarly-shaped magnetic bricks than in FIG. 1.
Figure 8:
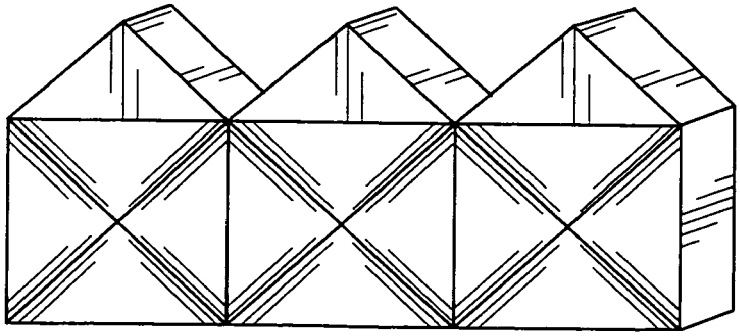
FIG. 8 shows a further embodiment of the present invention again using a larger number of similarly shaped magnetic bricks but of different sizes to those in FIG. 1.

FIGS. 7 and 8 show alternative forms of the puzzle, both additional embodiments again with magnets operating in the same way as described above.

A more detailed description of one specific embodiment of the present invention will now be discussed.

This puzzle consists of 5 identical bricks which are held together by magnet attraction to form the shape of a house. Each brick is the same shape and outward appearance as all the others.

The object of the puzzle is to separate the bricks from each other and then reassemble them again to give the shape of the house. When the bricks are assembled in the correct sequence the house can be picked up by the 'roof brick thus showing that each brick is firmly held to the others by their internal magnets.

Assembly of the puzzle is made non-trivial by means of an internal mechanism inside one of the bricks which is 'tripped' on disassembly so preventing re-assembly by simply pushing the bricks together again in the order in which they were taken apart. No other additional devices are needed to complete the correct (and mysterious) re-assembly. If the correct re-assembly sequence is not adhered to, then one or more of the bricks will not be attracted to the others and will not stay in place.

The bricks may be disassembled in any order but will frustratingly not return to their original positions in the assembly without further work on the part of the puzzle solver. If magnetic fields were visible and could easily be seen then this puzzle may be a little easier to solve.

Figure 9:
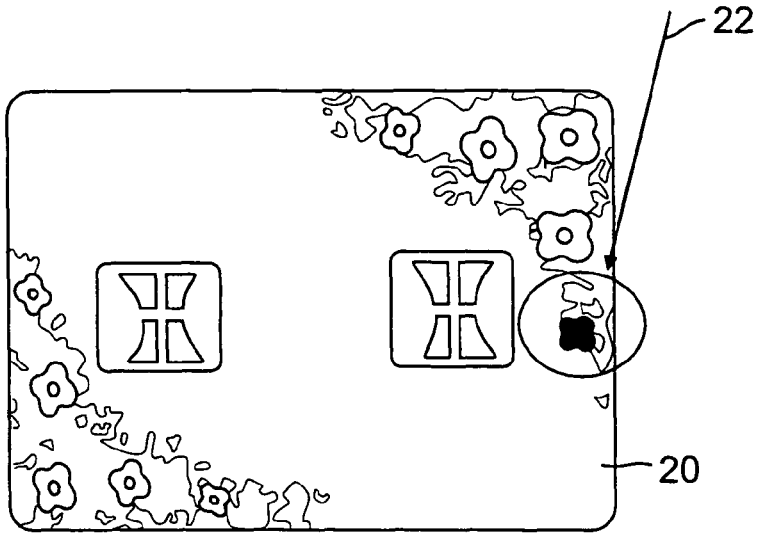
FIG. 9 is a bottom plan view of first brick 20 with a filled in flower 22.
Figure 10:
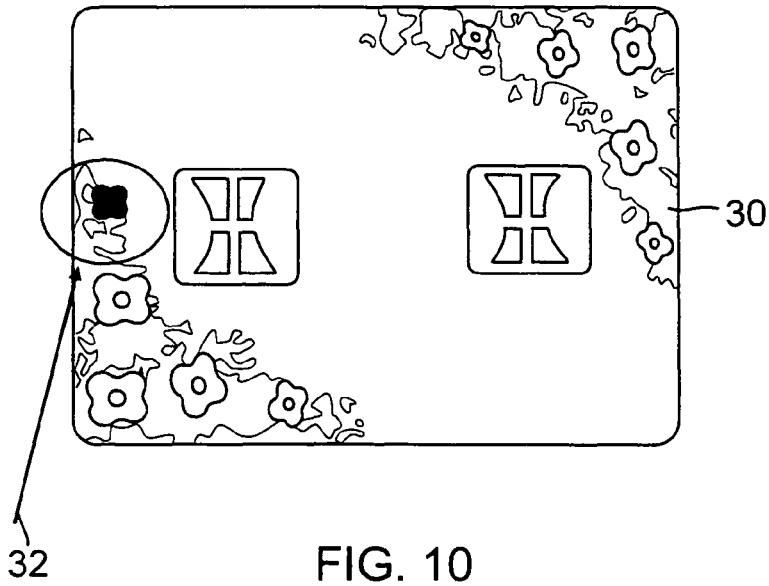
FIG. 10 is a bottom plan view of second brick 30 with a filled in flower 32.

Before the correct assembly sequence is given in detail, two important bricks will be identified which form the key to the whole assembly sequence. The two bricks in question are respectively illustrated in FIGS. 9 and 10 with each brick respectively numbered 20 and 30. The two bricks 20 and 30 will need to be manipulated in a certain way before any other bricks in the puzzle are brought into play.

Figure 11:
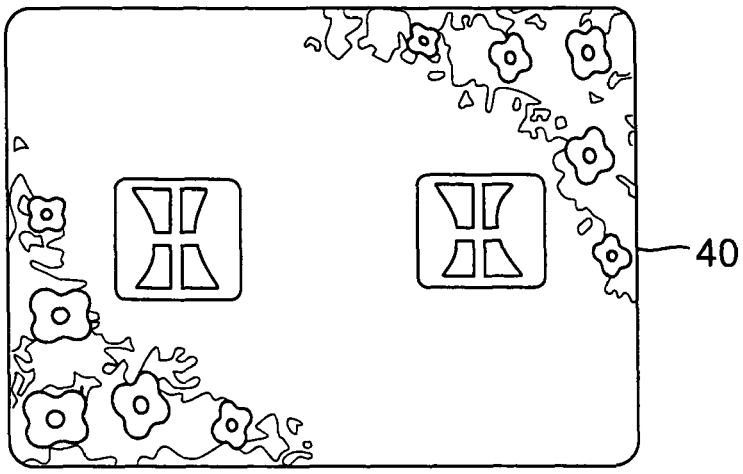
FIG. 11 is a bottom plan view of third symmetrical brick 40.
Figure 12:
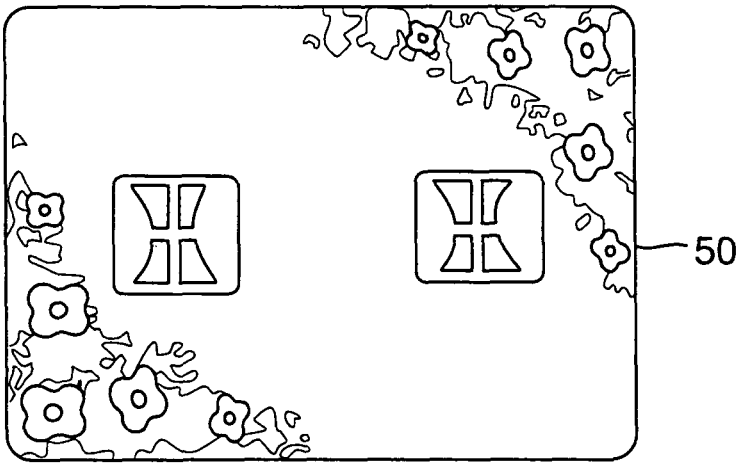
FIG. 12 is a bottom plan view of fourth symmetrical brick 50.
Figure 13:
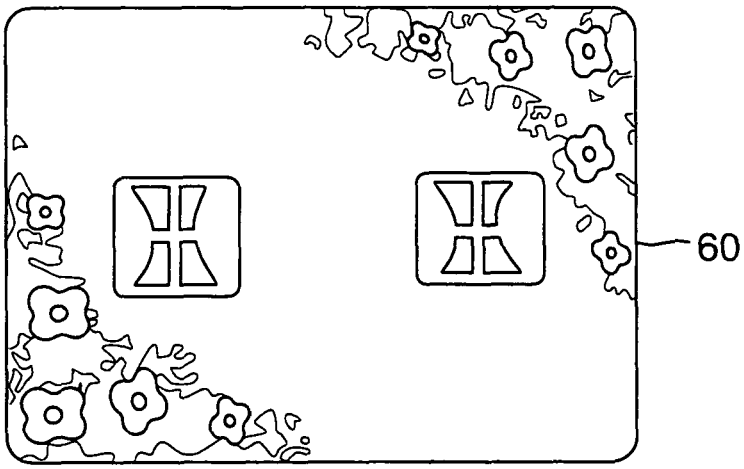
FIG. 13 is a bottom plan view of fifth symmetrical brick 60.

Bricks 20 and 30 are respectively identified by the 'filled-in' flower 22 and 32 as shown, whereas the pattern on bricks 40, 50 and 60 is symmetrical as shown in FIGS. 11, 12 and 13.

Step 1: Correct assembly of the house is first brought about by the identification of bricks 20 and 30.

Figure 14:
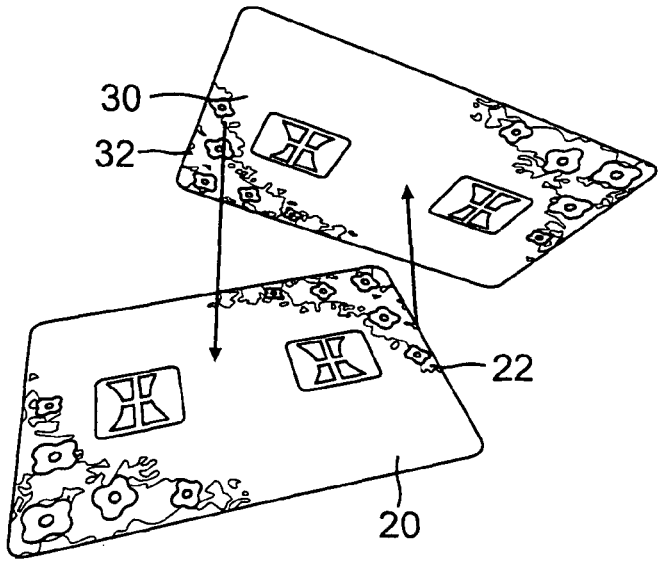
FIG. 14 is an illustration showing Step 1 which is the arrangement of bricks 20 and 30 with their filled in flowers 22 and 32 aligned.
Figure 15:
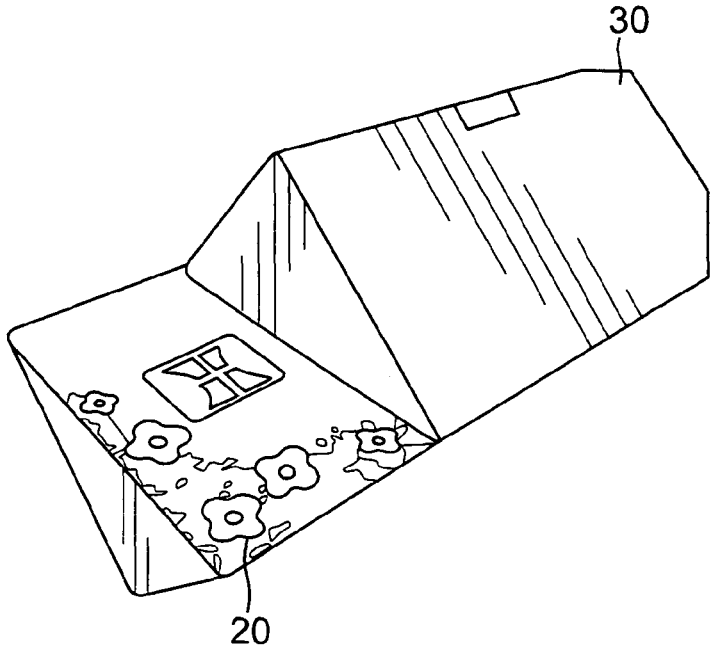
FIG. 15 is an illustration showing bricks 20 and 30 aligned so that the two bricks do not overlap more than half.

Arranging these two bricks with their 'filled-in' flowers aligned as shown FIG. 14 ensures that the bricks will correctly snap together into a configuration which will enable the internal mechanism inside one of the bricks to be set. Ensure the two bricks do not overlap more than half way, as illustrated in FIG. 15.

Step 2: The two bricks have automatically snapped together into the correct position under their combined magnetic attraction. One of the windows should be completely visible on each brick.

Figure 16:
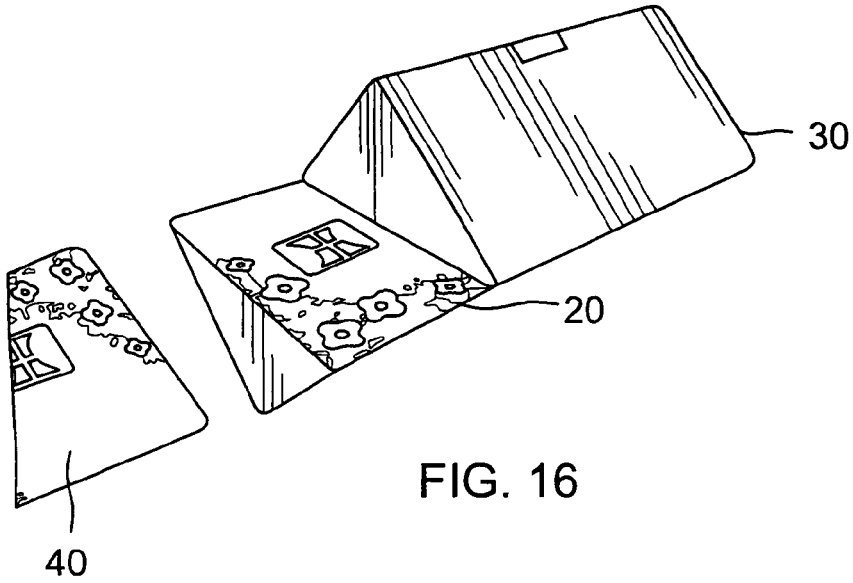
FIG. 16 is an illustration showing brick 40 coming into contact with bricks 20 and 30.

Step 3: As illustrated in FIG. 16, an additional brick 40 is now brought into contact against the end of one of the two bricks previously assembled. It will be found that one end of only one additional brick will be magnetically attracted to only one end of only one of the two bricks previously assembled in step 2, and this is the end to which the additional brick is to be brought into contact as shown in FIG. 16.

Figure 17:
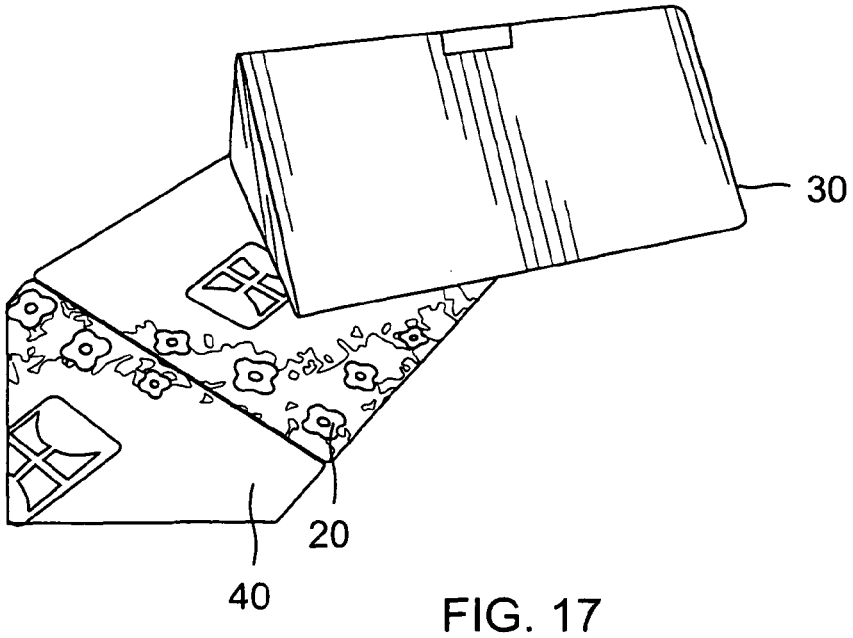
FIG. 17 is an illustration of having the brick 30 rotated clockwise when bricks 20, 30 and 40 are magnetically held together.

Step 4: With the additional brick 40 held magnetically in place next to bricks 20 and 30 as shown in FIG. 17, the top brick of the combined assembly is now slowly rotated clockwise when viewed from above. This begins to 'set' the internal mechanism thus facilitating further assembly of more pieces of the house puzzle.

Figure 18:
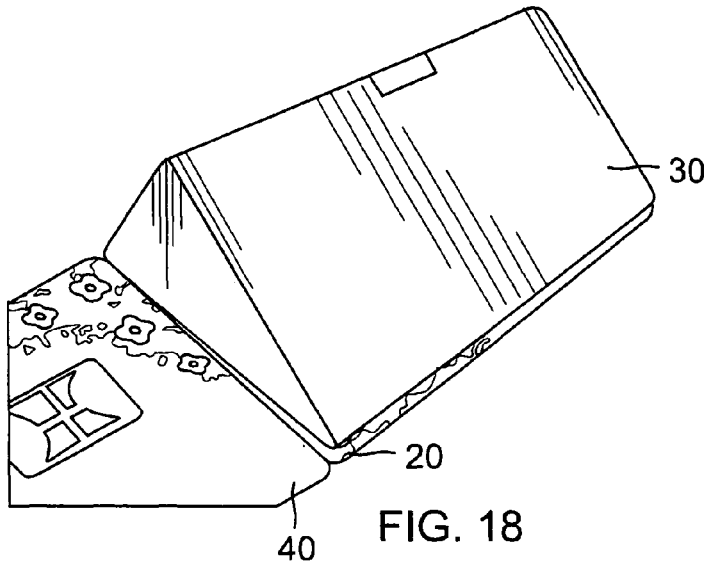
FIG. 18 is an illustration showing top brick 30 resting over bottom brick 20 with brick 40 magnetically connected to brick 20.

Step 5: As illustrated in FIG. 18, upon completing the clockwise rotation, the top brick will snap into its final location sitting completely over the lower brick and the setting of the internal magnetic mechanism will be complete.

Figure 19:
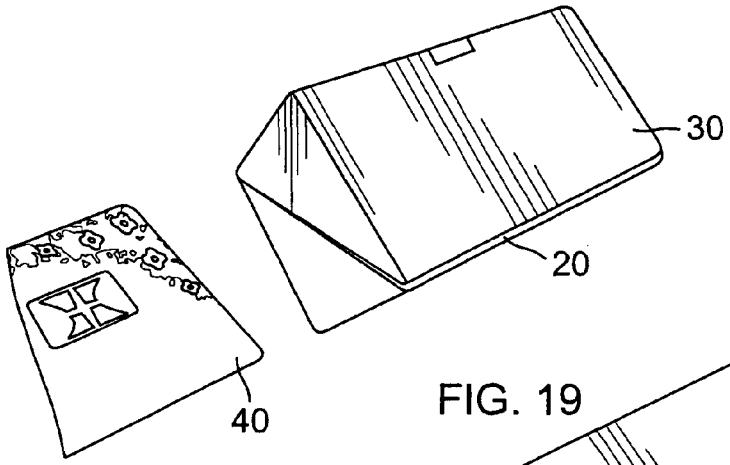
FIG. 19 is an illustration showing top brick 30 attached to bottom brick 20 with brick 40 separated.
Figure 20:
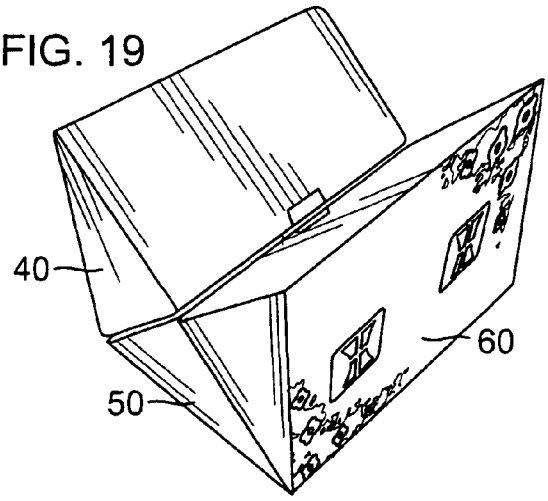
FIG. 20 is an illustration showing bricks 40, 50 and 60 assembled together.

Step 6: The additional brick 40 may now be removed to a distance thus leaving bricks 20 and 30 assembled as shown and held together by their mutual magnetic attraction, as illustrated in FIG. 19.

Step 7: Putting aside bricks 20 and 30 for the moment, the remaining three bricks have now to be assembled as shown in FIG. 30. This will need to be done by randomly placing together the three bricks 40, 50 and 60 in various positions by trial and error until all three bricks are mutually and firmly held together. The three bricks will only come together in one correctly combined orientation such that they are all tightly held by mutual attraction.

Figure 21:
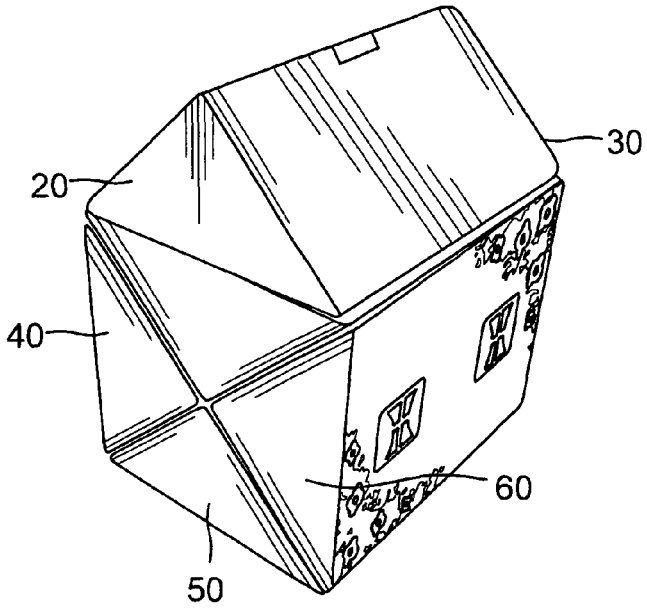
FIG. 21 is an illustration showing fully assembled bricks 20, 30, 40, 50 and 60.

Step 8: As illustrated in FIG. 21, the final step in the house building sequence is now carried out by placing the previously assembled bricks together. Place the two-brick assembly (20 and 30) on top of the three-brick assembly (40, 50 and 60). It will be found that only one orientation out of the possible four will allow the two assembled pieces to be fully attracted to each other (the puzzle-solver should ensure that the blue 'chimney' is on top of the roof—not the side).

Step 9: The completed house, correctly assembled, will allow the puzzle solver to lift up the assembled house by the top 'roof brick thus showing that all the pieces have been placed in their proper positions. No other sequence of assembly steps will allow this to be carried out as one or more of the magnets in some of the bricks will repel their adjacent bricks thereby allowing the house to fall apart if the above assembly sequence is not adhered to.

Figure 22:
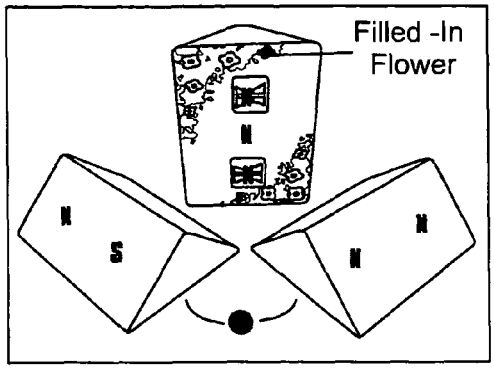
FIG. 22 is an illustration showing the orientation of each magnet in each brick.
Figure 22:
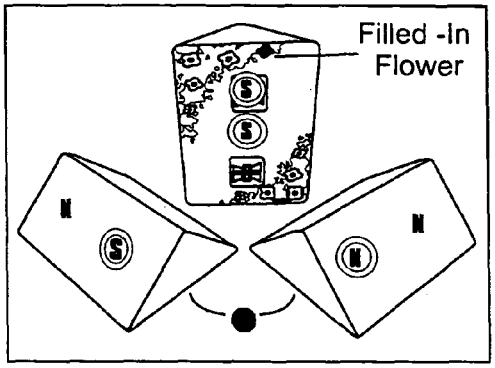
Figure 22:
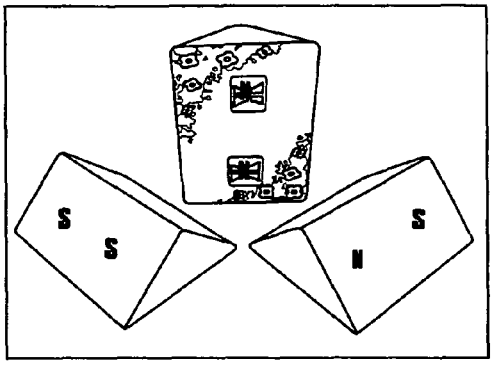
Figure 22:
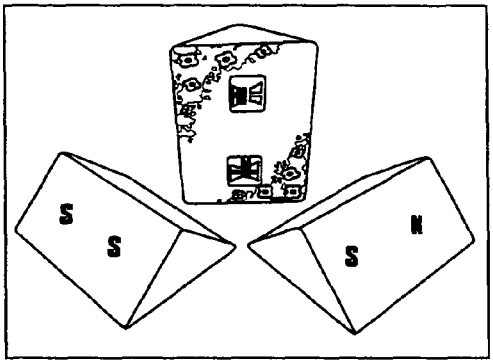
Figure 22:
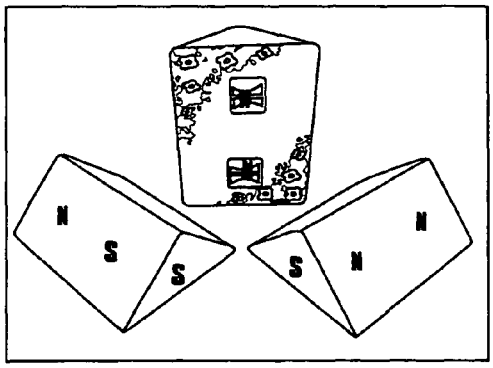

The puzzle's prototype, being made from wood, necessitated that the magnets be sunk and glued beneath the surface prior to the paint finish being applied—although a modern plastic construction would allow other more advanced fixings and efficient finishing techniques more closely compatible with mass production. As illustrated in FIG. 22, the following photographs show the locations and orientations, on each brick, of the fixed permanent magnets. The north or south pole of each hidden magnet's face and its position is indicated by a 'N' or "S" and, for bricks 20 and 30, the relative locations of the 'filled-in' flowers that mark the first pieces of the puzzle to be assembled, are shown by the dot.

All the magnets' positions are hidden from view by being sunk beneath the actual surfaces of the bricks.

Their locations are carefully placed so as to ensure that they coincide with the positions of the other bricks' magnets when the bricks are brought together.

Figure 23:
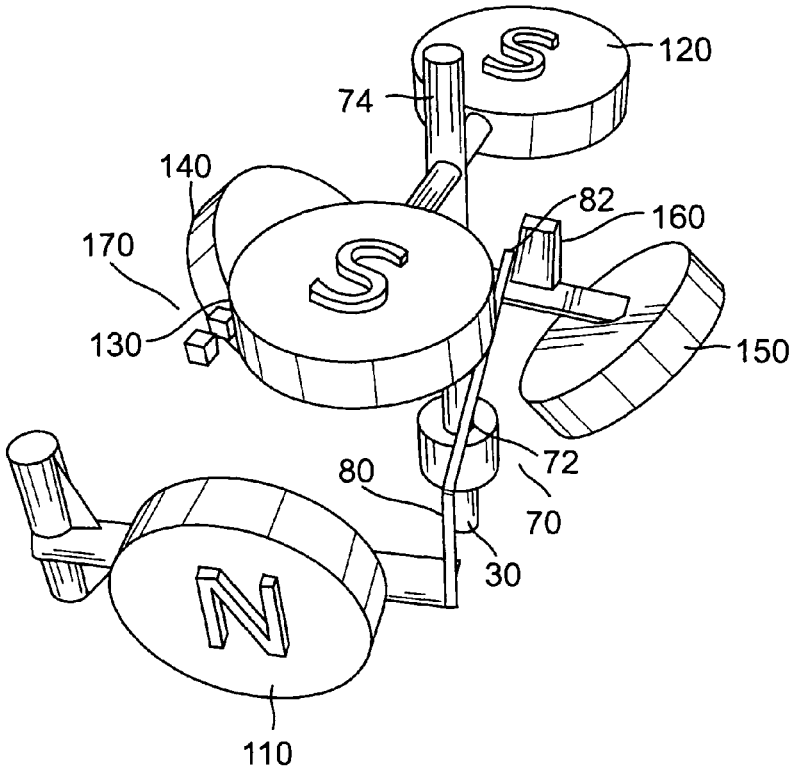
FIG. 23 is an illustration of the internal mechanism in the unset condition.

The following photographs and detailed descriptions illustrated in FIG. 23 all refer to the mechanism contained within brick 30.

The orientation of the mechanical diagrams is so arranged as to be looking inside brick 30 as though the brick was transparent.

Note that the 'filled-in' flower marker is at the far end of the brick and this will remain so throughout the following explanation.

The internal mechanism of brick 30 (shown in FIG. 23 in its 'unset" configuration) contains two moving parts: Carrier A and Carrier B and one helical spring 70. Both carriers are pivoted about their vertical axes such that they can rotate in a horizontal plane. Carrier A has one magnet 110 attached, the north pole of which faces towards the outer end of the brick 30.

Carrier B has four magnets 120, 130, 140 and 150 attached. Two of these magnets 120 and 130 are arranged with their south poles facing the top face of the brick 30 and the other two magnets 140 and 150 face the angled sides of the brick 30, the orientations of which are as shown in FIG. 22 which looks at the underside of this mechanism. The right-hand magnet 140 has its north pole facing to the right and the left-hand magnet 150 has its south pole facing to the left.

All the magnets on both carriers are so positioned to be as near to the inner wall of the brick without actually coming in contact with its inner surface, so allowing free movement of the carriers about their axes.

Carrier A has a lever 80 attached, the far end of which 82 contacts Stop 1—number 160 on Carrier B. This lever 80 prevents Carrier B from rotating clockwise when Carrier A's magnet has not been attracted by an additional brick being placed at the end of brick 30, as in assembly step 3 detailed in Magnetic House Building Puzzle.

Stop 2 (number 170), diametrically opposite, likewise prevents Carrier B from rotating counterclockwise past its initial "unset" position as shown. Carrier B is kept hard up against this stop by the energy of the pre-tensioned helical spring 70, one end of which 72 is anchored to the pivot 74 and the other end to the brick 30.

Figure 24:
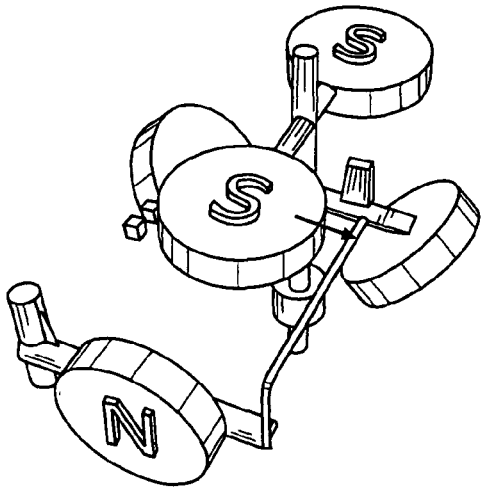
FIG. 24 is an illustration of assembly Step 3.

When assembly step 3 is carried out by placing an additional brick at the correct end of brick 30, the magnet on Carrier A is attracted to the end of the brick so moving its lever 70 away from Stop 1 as shown in FIG. 24. This action now allows Carrier B to be rotated clockwise by assembly step 4 discussed above.

Figure 25:
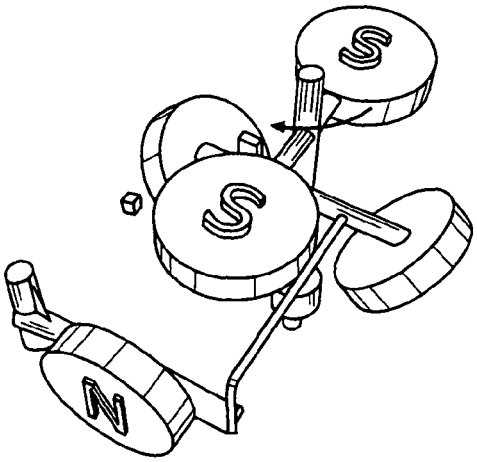
FIG. 25 is an illustration of assembly Step 5.

Upon completion of assembly step 5, the mechanism will be in the position as shown in FIG. 25. The resulting action has exchanged the magnetic poles of the two magnets which are adjacent to the angled sides of the brick 30. Magnetic pole north now being on the left, facing out and magnetic pole south on the right This enables further assembly of bricks 40, 50 and 60 which would not be correctly attracted to brick 30 had the magnets not exchanged sides.

When the additional brick 40 is moved away from brick 30 during assembly step 6, Carrier A will return to its original position, so awaiting the sprung counter-clockwise motion of Carrier B when bricks 20 and 30 are disassembled once more (Stop 1 easily ratchets past the end of Carrier A's lever).

Carrier A does not need a return spring to keep it in its original position, as this is facilitated by the residual attraction of the adjacent magnets within the brick.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A take-apart puzzle comprising:

a. the puzzle in the shape of a house made up from a small number of identically-shaped bricks in total with at least two of the bricks containing hidden magnets within the bricks' bodies;

b. the magnets hold separate bricks of the puzzle together;

c. one or more of the internal magnets are not rigidly fixed in their positions;

d. when all the bricks of the puzzle are removed from close proximity to each other, then one or more of the magnets are made to move and/or rotate to a different position by the action of internal and out-of-sight means within their respective bricks; and e. the movement and/or rotation of the magnets is brought about by the action of stored-energy devices or attractive or repulsive forces of additional magnets within their respective bricks.

2. A puzzle in accordance with claim 1, the internal magnets of which, after moving, are held in their new positions by internal means within their respective bricks even if the puzzle's bricks are brought back into close proximity with each other.

3. A puzzle in accordance with claim 2 whereby the constituent bricks will be repelled from one another by the force of their internal magnets thus preventing at least one or more of the bricks from being immediately reassembled back into their original places.

4. A puzzle in accordance with claim 3 whereby one or more of the constituent bricks have to be put through a complicated series of motions relative to one another in order to return the previously moved magnets to their original positions within the puzzle.

5. A puzzle in accordance with claim 4 wherein the so-moved magnets, which have now been moved back into their original positions, will thereby allow the further and complete assembly of the puzzle.

6. A puzzle in accordance with claim 1 wherein the outside appearance of the bricks when correctly assembled together, is made to resemble the outside of a house.

7. A take-apart puzzle comprising:

a. the puzzle in the shape of a house made up from a small number of identically-shaped bricks in total with at least two of the bricks containing hidden magnets within the bricks' bodies;

b. the magnets hold separate bricks of the puzzle together;

c. the magnets are prevented from moving within their respective bricks due to the attractive forces from adjacent magnets in adjacent bricks;

d. when all the bricks of the puzzle are removed from close proximity to each other, then one or more of the magnets are made to move and/or rotate to a different position by the action of internal and out-of-sight means within their respective bricks; and e. the movement and/or rotation of the magnets is brought about by the action of stored-energy devices or attractive or repulsive forces of additional magnets within their respective bricks.

8. A puzzle in accordance with claim 7, the internal magnets of which, after moving, are held in their new positions by internal means within their respective bricks even if the puzzle's bricks are brought back into close proximity with each other.

9. A puzzle in accordance with claim 8 whereby the constituent bricks will be repelled from one another by the force of their internal magnets thus preventing at least one or more of the bricks from being immediately reassembled back into their original places.

10. A puzzle in accordance with claim 9 whereby one or more of the constituent bricks have to be put through a complicated series of motions relative to one another in order to return the previously moved magnets to their original positions within the puzzle.

11. A puzzle in accordance with claim 10 wherein the so-moved magnets, which have now been moved back into their original positions, will thereby allow the further and complete assembly of the puzzle.

12. A puzzle in accordance with claim 7 wherein the outside appearance of the bricks when correctly assembled together, is made to resemble the outside of a house.

* * * * *